US006381885B1

(12) United States Patent
Ficco, Jr.

(10) Patent No.: US 6,381,885 B1
(45) **Date of Patent: *May 7, 2002**

(54) GOLF BALL CALENDAR

(76) Inventor: H. Richard Ficco, Jr., 5 Emerson Dr., South Easton, MA (US) 02375

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/940,192

(22) Filed: Sep. 29, 1997

(51) Int. Cl.[7] ..... G09D 3/00
(52) U.S. Cl. ..... 40/107; 283/2; D19/25
(58) Field of Search ..... 40/107, 110, 120; 283/2; 211/14; D19/20, 25; D6/552

(56) References Cited

U.S. PATENT DOCUMENTS

| | | | | | |
|---|---|---|---|---|---|
| 992,396 | A | * | 5/1911 | Weber | 211/14 |
| 3,228,686 | A | * | 1/1966 | Faulkner et al. | 40/327 X |
| 3,579,882 | A | * | 5/1971 | Miyahune | 40/107 |
| 4,058,916 | A | | 11/1977 | Whyatt | 40/107 |
| 4,214,390 | A | * | 7/1980 | Kluiters | 40/447 |
| 4,472,892 | A | * | 9/1984 | Yang | 40/107 |
| 4,524,968 | A | * | 6/1985 | Dolp | 211/14 X |
| 4,934,076 | A | * | 6/1990 | Fowler | 40/107 |
| 4,955,485 | A | * | 9/1990 | Alton | 211/14 |
| 4,975,061 | A | | 12/1990 | Ayrill | 434/304 |
| 5,478,612 | A | | 12/1995 | Hack et al. | 428/11 |
| D366,584 | S | * | 1/1996 | Ellis | D6/552 |
| 5,542,680 | A | * | 8/1996 | Proudfit et al. | 40/327 X |
| 5,555,496 | A | * | 9/1996 | Tackbary et al. | 364/401 R |
| D386,925 | S | * | 12/1997 | Hogan | D6/552 |
| 5,746,332 | A | * | 5/1998 | Kleinschmidt | 211/153 |
| 5,926,985 | A | * | 7/1999 | Arbuckle | 40/358 X |
| 5,992,064 | A | * | 11/1999 | Gubernick | 40/107 |

FOREIGN PATENT DOCUMENTS

| | | |
|---|---|---|
| FR | 2 312 081 | 12/1976 |

OTHER PUBLICATIONS

Yield House Christmas Catalog, 1997, page 17, Golf Ball Display.

* cited by examiner

*Primary Examiner*—Brian K. Green
(74) *Attorney, Agent, or Firm*—Christopher S. Schultz

(57) ABSTRACT

A calendar is provided that includes a plurality of spherical objects mounted in a case that correspond to the days of the month. The spherical objects are preferably golf balls that include numerical indicia thereon for indicating the particular day of the month. The spherical objects can also include additional indicia thereon for indicating a particular holiday.

5 Claims, 4 Drawing Sheets

GOLF BALL CALENDAR

FIELD OF THE INVENTION

This invention relates to apparati which function as calendars. More specifically, the invention relates to a calendar that uses spherical objects such as golf balls corresponding to the days of the month.

DETAILED DESCRIPTION

Figure 1:
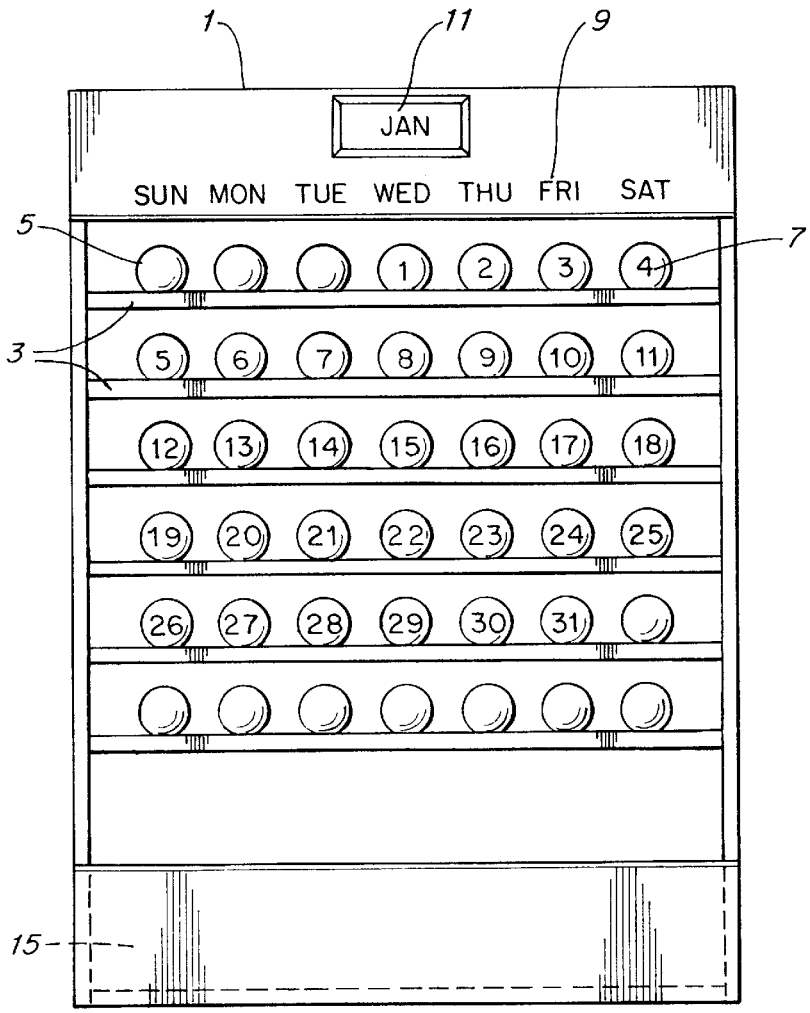
FIG. 1 is a front plan view of the calendar according to one embodiment of the present invention.
Figure 2:
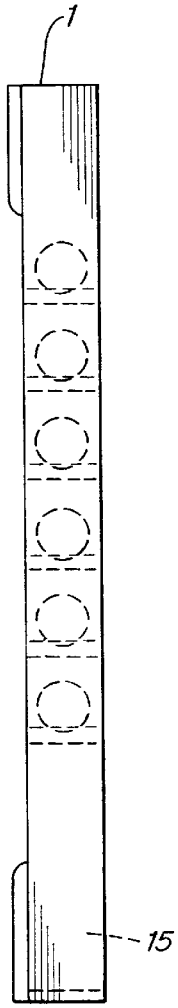
FIG. 2 is a side view of the calendar of FIG. 1.

FIGS. 1 and 2 show one embodiment of the calendar according to the present invention. The calendar includes a case 1 which includes a plurality of shelves 3 for accommodating and supporting a plurality of spherical objects 5. The spherical objects are preferably golf balls. Each spherical object includes numerical indicia 7 thereon corresponding to a particular day of the month.

The case 1 also includes indicia 9 thereon for indicating the days of the week, and indicia 11 for indicating the particular month. The indicia 11 is non-permanent, and can be changed from month to month. For example, a card indicating the particular month thereon can be slid into a slot mounted on the case. Alternatively, spherical objects 5 can be used to indicate the particular month in the same manner they are used to indicate the day. For example, three objects with the letters "J", "A" and "N" thereon respectively, for indicating the month of January, can be mounted on the top shelf 3. Further, instead of indicia 9, the days of the week can also be indicated on the spherical objects, on a shelf above the days of the month.

Figure 3:
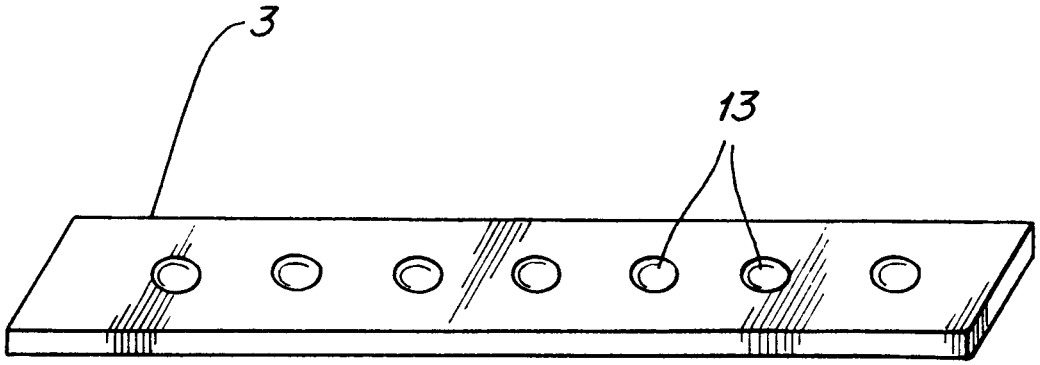
FIG. 3 is a perspective view of a shelf used in the calendar of FIGS. 1–2.
Figure 4:
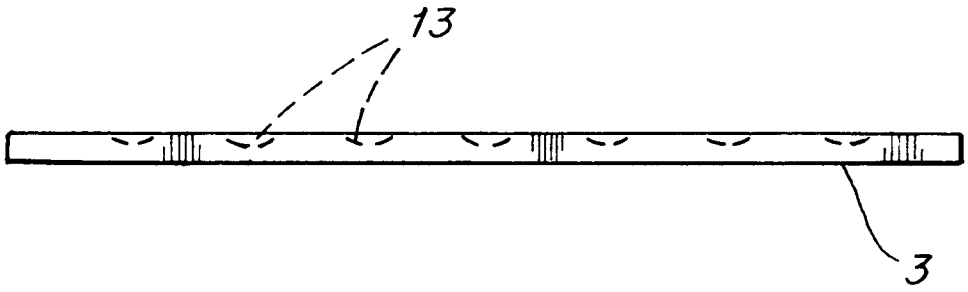
FIG. 4 is a side view of the shelf shown in FIG. 3.

As shown in FIGS. 3–4, shelves 3 include indents 13 for supporting the spherical objects 5. The indents 13 make movement of the spherical objects 5 from one indent to the other a simple matter when changing from one month to the next—creating a "perpetual" calender that does not have to be disposed of at month's end. The indents 13 also permit the spherical objects 5 to be rotated easily within its particular indent. The objects can be rotated, for example, when a day passes by to so that the numerical indicia 7 of the day gone by is hidden. Further, the object 5 may include a stylized logo on the side of the object opposite the numerical indicia which represents a particular holiday of a particular month. For example, the spherical object 5 with the numeral 31 thereon may include a jack-o'-lantern on the opposite side which can be rotated to the front during the month of October to indicate Halloween.

The case also includes a hollowed-out area 15 which can be used to store extra spherical objects 5, which are not used during the particular month that includes less than 31 days.

Figure 5:
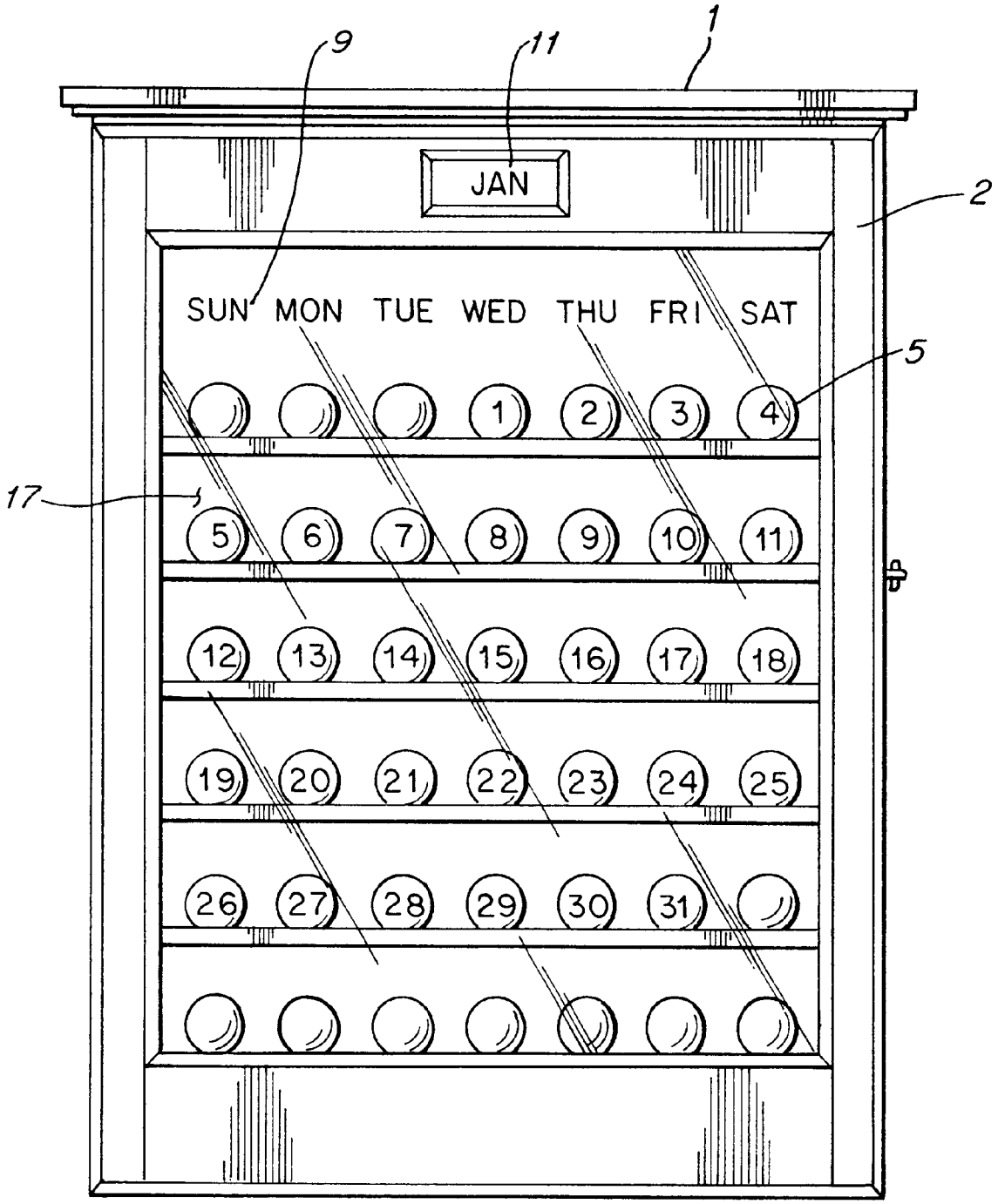
FIG. 5 is a front plan view of an alternative embodiment of the calendar according to the present invention.
Figure 6:
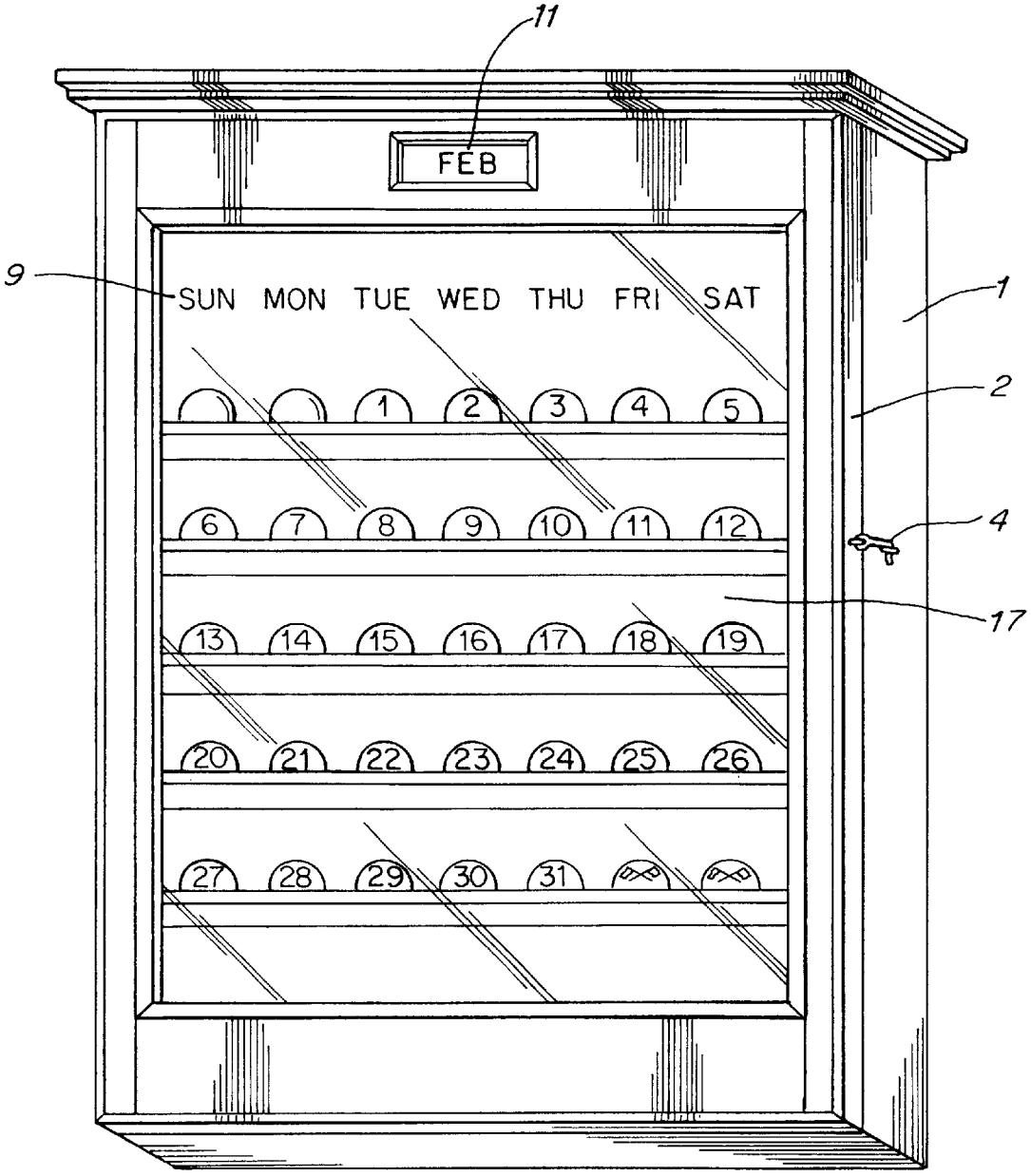
FIG. 6 is a perspective view of the calendar of FIG. 5.

FIGS. 5 and 6 show alternative embodiments of the present invention in which the spherical objects 5 are enclosed in a case 1 which includes a glass cover 17. In this case the glass cover 17 is mounted in a door 2 which is hinged to the main body of the case 1, and includes a hook for keeping the door closed. The indicia 9 which indicates the particular day of the week is permanently mounted on the glass casing. FIG. 6 shows a different month than FIG. 5, thus, the objects indicating the days of the month are arranged in different indents.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. A calendar comprising:

a case;

at least five shelves mounted within the case; and at least 28 golf balls supported by said shelves, the golf balls being uniquely numbered with numerical indicia from 1 to at least 28 in order that the golf balls can be sequentially arranged on said shelves according to said numbers for indicating the days of a month, the golf balls forming seven vertical columns corresponding to the seven days of the week, wherein the shelves are constructed and arranged to support said golf balls in a manner permitting said golf balls to be freely arranged and re-arranged on said shelves in said columns in order that a position of the numbered golf balls can be changed according to a particular month being displayed.

2. The calendar according to claim 1 wherein each shelf includes a plurality of indents for supporting said golf balls.

3. The calendar according to claim 1, wherein at least one of the golf balls includes indicia, in addition to the numerical indicia, corresponding to a particular holiday.

4. The calendar according to claim 3, wherein the at least one of the golf balls includes said numerical indicia on one side, and the indicia corresponding to a particular holiday on an opposite side.

5. The calendar according to claim 4, wherein each shelf includes a plurality of indents for supporting said golf balls.

* * * * *